US005979897A

United States Patent [19]

Grossman

[11] Patent Number: 5,979,897

[45] Date of Patent: Nov. 9, 1999

[54] METHOD OF PLAYING BLACKJACK

[75] Inventor: Howard Francis Grossman, Las Vegas, Nev.

[73] Assignee: Tech Art Management, Inc., Las Vegas, Nev.

[21] Appl. No.: 09/007,243

[22] Filed: Jan. 14, 1998

[51] Int. Cl.[6] ..... A63F 1/00

[52] U.S. Cl. ..... 273/292

[58] Field of Search ..... 273/292, 274, 273/309; 463/12

[56] References Cited

U.S. PATENT DOCUMENTS

| | | | |
|---|---|---|---|
| 5,257,789 | 11/1993 | LeVasseur | 273/309 |
| 5,257,810 | 11/1993 | Schorr et al. | 273/292 |
| 5,393,067 | 2/1995 | Paulsen et al. | 273/292 |
| 5,413,353 | 5/1995 | Demarest | 273/292 |
| 5,615,888 | 4/1997 | Lofink et al. | 273/292 |
| 5,632,485 | 5/1997 | Woodland et al. | 273/292 |
| 5,636,843 | 6/1997 | Roberts | 273/292 |
| 5,673,917 | 10/1997 | Vancura | 273/292 |

OTHER PUBLICATIONS

Scarne's Encyclopedia Of Games, John Scarne, Harper & Row Publishers, pp. 279–286, Dec. 1973.

Maverick Blackjack, Sep. 1995.

Wong, Basic Blackjack, 1993, Pi Yee Press, pp. 18–142.

*Primary Examiner*—Benjamin H. Layno

*Attorney, Agent, or Firm*—David Comarow

[57] ABSTRACT

Disclosed is a method for playing a modified form of Blackjack ("Twenty-One") using one or more standard 52-card decks, and having rule variations to increase the excitement of the game while retaining the same "take" for the house within approximately 1%. By paying even-money on any blackjack (even on a "push"), rather than 1.5:1 if there is no push, shifts the take in favor of the house sufficiently to create several special rules greatly adding to the excitement of the game. Specifically, blackjack in a specified suit pays 2:1. Five or more cards totaling exactly 21 pays 2:1. Six-cards totaling 20 or less pays 1:1. No bonuses are paid on double-down hands. The player may split all equal-value cards three times, including Aces. The player may double-down on any number of cards, even after splitting and hitting, including Aces. The player may surrender one half her bet on any "unbusted" hand, even after hitting, doubling-down or splitting. In the preferred embodiment, the player may place a "side bet" on her getting a blackjack in a designated suit (e.g. diamonds) in the first round of a newly shuffled deck or decks, paying 300:1. Variations include allowing the player to designate the designated suit or suits for the special single-suit prize (i.e. 2:1 on regular wager, 300:1 on side bet).

17 Claims, 1 Drawing Sheet

METHOD OF PLAYING BLACKJACK

BACKGROUND OF THE INVENTION

"Blackjack" or "Twenty-One" is a popular card game in casinos. It is simple to play and may be implemented as a "live" table game or in electronic (video) form. The "normal" basic rules are these: The player receives two cards, either face-up or face-down. The dealer receives two cards, one face-up and one face-down. Face cards count as 10, Aces count as either 1 or 11, numbered cards count as their face value. If the dealer has a total of 21 (an Ace and Jack, Queen, King or 10-spot) in the first two (2) cards (called "blackjack"), the house wins and the player loses her wager, unless the player also has blackjack, in which case it is a draw or "push." If the dealer does not have blackjack, the player may "stand" or take a "hit" (be dealt an additional card). The player may continue taking "hits" until she decides to "stand" or "busts" (exceeds 21). Once the player declines any additional cards (stands), the dealer takes hits if he has below a total of 17. If the dealer has 17 or higher, he must "stand" (take no additional cards). If both the player and the dealer have the same total in their hands, it is a "push," and the player breaks even. If the player has a higher total than the dealer without going over 21, or the dealer busts (has over 21), then the player is paid 1-to-1 (also referred to as "2-for-1" ). In addition, if the player is initially dealt a pair, he may split them into two hands by placing a new bet on the new hand. A player may also double-down on the originally-dealt two cards, but not after splitting.

The lack of complexity of the game, and the relatively low payouts often cause players to become bored and lose interest. Several variations of Blackjack have been implemented in recent years, primarily designed to enable higher pay-outs. For example, U.S. Pat. No. 5,615,888 titled Spanish Twenty-One Card Game Method of Play issued to Lofink describes a variation on Blackjack in which the Tens are removed from the deck of cards. By so reducing the deck, the odds are greatly shifted in the house's favor, allowing special payouts for certain card combinations (e.g. five card 21 pays 3-to-2, 7–7–7 same suit pays 2-to-1). Players, however, may view the removal of the Tens from a deck as an unfair advantage in favor of the house. A method is therefore desired in which the interest level can be increased significantly without modifying the standard deck of fifty two cards and without significantly changing the standard payout schedule.

SUMMARY OF THE INVENTION

The present invention accomplishes a significant increase in excitement and interest in Blackjack by modifying the typical pay-out for obtaining blackjack (one-to-one (1:1) as opposed to 1.5:1). This seemingly small modification significantly shifts the overall house take. In a "normal" Blackjack game, paying a player 1.5:1 for obtaining blackjack (but breaking even on a "push") costs the house 2.3%. Whereas, paying all players 1:1 for blackjack (even if it is a "push") benefits the house 2.1%.

This variation allows extra payouts for special card combinations: five or more cards totaling 21 pays 2:1; six cards totaling 20 or less pays 1:1 (even if the dealer has a better hand). It further allows the player to be able to split all equal-value cards up to three times. It further allows doubling-down on any number of cards, even after splitting and hitting (including aces). It further allows the player to surrender one-half her original bet on any "unbusted" hand (i.e. where the dealer does not have blackjack and the player has less than 21).

Additionally, in the preferred embodiment of the present invention, the player has the option to place a "side bet" on the first hand of round of play (a freshly shuffled deck or decks). If the player gets blackjack in a specified suit (e.g. diamonds) on her hand dealt in the first round, she gets 300:1 odds on the "side bet," in addition to 2:1 for the regular wager.

Thus, by modifying only the payout on the player receiving blackjack, all the other changes listed above may be implemented without changing the over-all take of the house more than approximately 1%. The level of excitement is much improved as compared to "normal" Twenty-One. Table 1 below details the statistical changes in the overall "take" of the house:

TABLE 1

| Rule | Approximate Net Change in House's "Take" Compared to Standard Blackjack Game |
|---|---|
| 1. Blackjack pays 1:1 (as opposed to 1.5:1 in "normal" 21). | +2.1% |
| 2. Dealer hits soft-17 (as opposed to standing in all 17's in "normal" 21). | +.2% |
| 3. Blackjack in specified suit pays 2:1 (as opposed to 1.5:1 regardless of suit in "normal" 21). | −.2% |
| 4. Five or more cards totaling exactly 21 pays 2:1 instantly, except on double-down hands (regardless if dealer pushes). | −.2% |
| 5. Six cards totaling 20 or less instantly pays 1:1, except on double-down hands (even if dealer has or gets better hand). | −.1% |
| 6. Player may double-down on any number of cards, even after splitting and hitting (including Aces). Split all equal-valued cards up to three times, including Aces. | −.4% |
| 7. Player may "late" surrender half her bet on any unbusted hand, even after hitting, doubling or splitting. | −.3% |

If the player uses the theoretical best playing strategy, the approximate minimum house advantage for the above rules are as follows:

| | |
|---|---|
| One Deck: | +1.1% |
| Two Decks | +1.4% |
| Three Decks | +1.5% |
| Four or more Decks: | +1.6% |

The player "side bet" described above wherein she receives 300:1 odds if she obtains blackjack in a specified suit (e.g. diamonds) has a house advantage of approximately +10.5%.

DESCRIPTION OF THE RELATED ART

As described above, Blackjack is a widely-played casino card game. The challenge of making it more exciting to play has led to several variations. First played at Vegas World in Las Vegas, Nev. in 1979 was "Double Exposure Twenty-One" in which both dealer's cards were dealt face-up. In Double Exposure 21, The dealer wins all pushes (ties) except blackjack. Blackjack pays even-money. There is never doubling-down after splits or surrendering. There are several variations including whether the dealer stands on a "soft 17."

U.S. Pat. No. 5,257,810 titled Method of Playing a Blackjack Type Card Game describes a method of play for a variant of Twenty-One in which the dealer plays two hands—a "dealer" hand and a common "player hand." The players play no card hands themselves but bet on which hand (the "dealer" or "common player" hand) will win. This method lacks the interactive excitement of actually playing a hand and making choices during the game.

U.S. Pat. No. 5,413,353 titled Method of Playing a Blackjack Type Card Game describes a "normal" Twenty-One game except that the players compete against each other for a common "pot," and the house takes a "rake," much the way poker is widely played in casinos.

The interconnection of multiple live card games to allow payment of a large "progressive" prize is described in U.S. Pat. No. 5,393,067 titled System, Method and Apparatus for Generating Large Jackpots on Live Game Card Tables. This patent describes the placement of a "side bet" in order to qualify for the progressive jackpot. It does not teach any modifications for the play of the game to make it more exciting or interesting.

U.S. Pat. No. 5,632,485 titled Card Game with Side Bet Options describes a variation on Twenty-One in which the player has the opportunity of placing a "side bet" on whether she will receive a certain type of hand known as a "stiff" or a "soft" hand in the initial deal. i.e. a hand is "stiff" if the first two cards total 12 to 16 where one Ace is counted as eleven. However, the play of the Twenty-One game remains standard.

As discussed above, U.S. Pat. No. 5,615,888 titled Spanish Twenty-One Game Method of Play requires the removal of the 10-spot cards from a normal deck, resulting in a 48-card deck.

This invention allows for variations in the play of a Blackjack game such as allowing doubling-down on any hand, paying three to two odds on a player getting blackjack regardless of the dealer's hand count, and declaring the player a winner whenever she gets a total of 21 regardless of the dealer's hand count. The game allows for various schedules of special pay-outs for certain card combinations such as five-card 21 pays 3 to 2, 7–7–7 same suit pays 2 to 1, etc. However, Spanish Twenty-One requires the use of a non-standard deck.

Thus a method for playing Blackjack which increases the level of excitement and player interest would be desired. A combination of increased jackpots and rich rules of play without the need for modifying standard playing card decks or providing complicated and expensive electronic devices (such as required by the '766 patent, the '067 patent and the '485 patent described above) is desired.

DETAILED DESCRIPTION OF THE INVENTION

Figure 1:
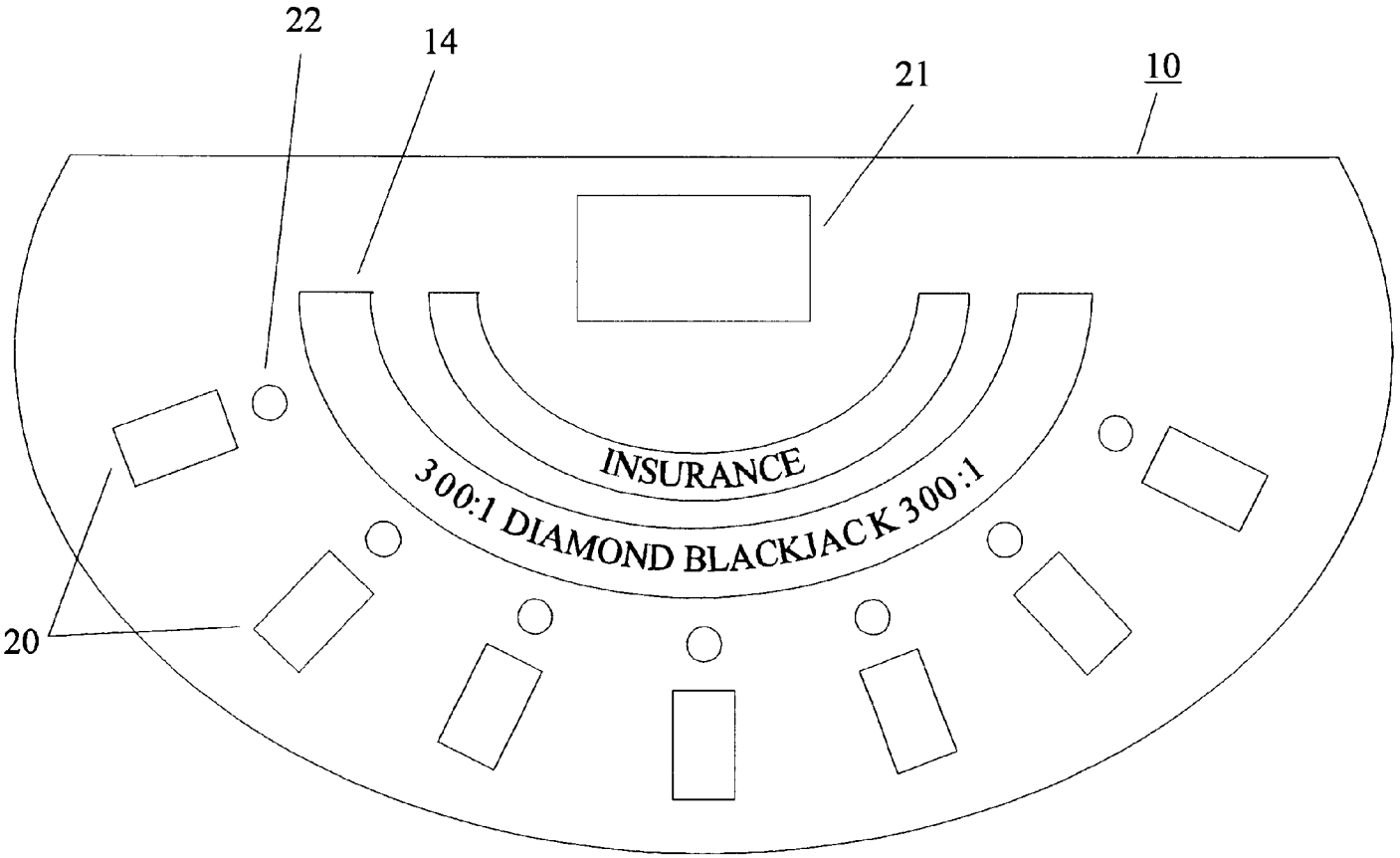
FIG. 1 is a top planar view of a card table specially modified for play according to the method described.

In its preferred embodiment, the invention is a modified form of Blackjack using one or more standard 52-card decks. The game is played at a standard Blackjack card table 10 with the addition of a "side bet" placement spot 14 at each player location 16. After shuffling the deck or decks, before the initial hand of a round is dealt, each player has the option of placing a "side bet" by placing a wager on a designated spot 14 on the table 10. Each player then places a wager on the game by placing the wager in the designated spot 22. The dealer then deals to each player two cards face-up on the designated location 20, and two cards to himself, one face-up and one face-down, on the designated location 21. If a player has placed a "side bet" on the designated side-bet spot 14, and, in the first hand dealt in the round, obtains a single-suit "blackjack" in a designated suit (e.g. diamonds) the player is paid 300-to-1 odds on her side bet, plus 2:1 on the original wager 22, (even if the dealer has "blackjack") and the game ends for that player. If a player who has not placed a "side bet" obtains a single-suit "blackjack" in the designated suit (e.g. diamonds), she is paid 2-to-1 odds on her game bet 22 (even if the dealer has "blackjack). If a player obtains "blackjack" in any suit combination not specially designated, she is paid 1-to-1 ("even-money") regardless of the dealer's hand. If the dealer has "blackjack", the house collects the wagers of any player who does not also have "blackjack."

If the dealer's initially-dealt two cards total less than 21 (i.e. he does not have "blackjack"), the game proceeds for any player who did not have "blackjack." Players may now request additional cards ("hits") until they wish to stand (with a total equal to or less than 21, or exceed 21 ("bust") and lose. After each player in sequence has completed taking hits, the dealer then draws cards until he makes a "hard" 17 (i.e. if an Ace or Aces are included in the hand, each Ace counts only as 1 and not 11), his cards total 21 or he "busts." The dealer must take a "hit" on a "soft 17" (i.e. an ace in the hand counts as 11) but must stand on "soft 18" or higher, or on a "hard 17" or higher.

In "normal" Blackjack, if a dealer has a higher total than a player without exceeding 21, the dealer wins. However, in the present invention, there are certain exceptions to this rule. Specifically, if a player has six-cards totaling 20 or less, she wins 1-to-1 ("even-money") even if the dealer has a higher total. Additionally, if a player has five or more cards totaling exactly 21, she is paid 2-to-1 odds regardless of the dealer's hand.

In "normal" 21, most casinos permit players to double-down only on the originally-dealt two-card hand. In the present invention, a player may double-down on any number of cards, even after splitting. Once a player "doubles-down," she receives only one more card. A player may "split" any equal-value cards up to three times, including Aces.

In "normal" Blackjack, if a dealer does not have "blackjack," a player may surrender half her bet only on the first two cards dealt. In the present invention, a player may surrender half her bet on any hand that is not "busted" (does not exceed 21), even after doubling or splitting, so long as the dealer's initially-dealt two cards did not equal 21 (i.e. blackjack).

Having described the present invention, it will be understood to those skilled in the art that many variations of the present invention are possible without departure from the scope of the present invention. For example, the designated suit for winning 2-to-1 odds (or 300-to-1 odds on a "side bet") on the occurrence of obtaining a single-suit blackjack could be any suit chosen in advance, and may even be changed with each hand. Additionally, the payout for certain hands may be adjusted downward to permit increasing the payout of other hands. The game may be implemented as a live table game or in electronic form. Thus, it will be understood that the foregoing is not intended to limit the invention to the specific examples described. To the contrary, it is intended to cover all alternatives, modifications and equivalents as may be included within the spirit and scope of the invention as defined by the appended claims. It is clear that this invention is susceptible to numerous modifications and embodiments within the ability of those skilled in the art and without the exercise of inventive process. Accordingly, the invention should not be limited by the foregoing description, but should be defined only by the appended claims.

What is claimed is:

1. A method of playing a modified version of Blackjack comprising:

a) providing one or more decks of fifty two cards consisting essentially of four Aces, four Twos, four Threes, four Fours, four Fives, four Sixes, four Sevens, four Eights, four Nines, four Tens, four Jacks, four Queens and four Kings;

b) a player making a wager to be eligible to play a hand;

c) a dealer dealing two cards to the player and two cards to the dealer, one of the dealer's cards being dealt face-up;

d) designating a first specified suit;

e) if the player's cards are a blackjack in other than said first specified suit, paying the player one-to-one odds on the amount of his wager regardless of the contents of the dealer's cards even if the dealer also has blackjack;

f) the player standing on her first two cards or drawing additional cards, as desired;

g) the dealer standing on hard-seventeen.

h) if the player obtains a blackjack in said first specified suit, paying two-to-one odds;

i) allowing the player to double-down on any number of cards totaling 21 or less;

j) allowing the player to double-down after splitting;

k) allowing player to split all equal-value cards of any value up to three times;

l) if the dealer does not have blackjack, allowing the player to surrender half her bet on any hand including after splitting or doubling-down.

2. The method as recited in claim 1 further comprising the dealer hitting on soft-seventeen and standing on hard 17.

3. The method recited in claim 1 further comprising paying a player two-to-one (2:1) odds in the event the player's hand contains five or more cards and totals exactly 21.

4. The method as recited in claim 1 further comprising paying a player one-to-one (1:1) odds in the event the player's hand contains six or more cards and totals twenty or less.

5. The method as recited in claim 1 wherein if the player and the dealer both have a blackjack, paying the player one-to-one odds.

6. The method as recited in claim 1 wherein said first specified suit, is diamonds.

7. The method as recited in claim 1 further comprising designating a second specified suit;

giving the player the option to place a "side bet" before the play of a hand begins;

paying the player three hundred-to-one (300:1) odds on said side-bet in the event she receives a blackjack in said second specified suit in the first round of play.

8. The method as recited in claim 7 wherein said second specified suit is the same suit as said first specified suit.

9. The method recited in claim 7 further comprising giving a player the option to designate said second specified suit before the beginning of a round of play.

10. The method recited in claim 1 further comprising giving a player the option to designate said first specified suit before the beginning of a round of play.

11. A method of playing a modified version of Blackjack comprising:

a) providing one or more decks of fifty two cards consisting essentially of four Aces, four Twos, four Threes, four Fours, four Fives, four Sixes, four Sevens, four Eights, four Nines, four Tens, four Jacks, four Queens and four Kings;

b) a player making a wager to be eligible to play a hand;

c) a dealer dealing two cards to the player and two cards to the dealer, one of the dealer's cards being dealt face-up;

d) if the player's cards are a blackjack, paying the player one-to-one odds on the amount of his wager regardless of the contents of the dealer's cards even if the dealer also has blackjack;

e) the player standing on her first two cards or drawing additional cards, as desired;

f) if the player obtains a blackjack in a first specified suit, paying two-to-one odds;

g) allowing the player to double-down on any number of cards;

h) allowing the player to double-down after splitting;

i) allowing player to split all equal-value cards of any value up to three times;

j) if the dealer does not have blackjack, allowing the player to surrender half her bet on any hand including after splitting or doubling-down;

k) paying two-to-one (2:1) odds in the event the player obtains blackjack containing five or more cards, regardless of the contents of the dealer's hand;

l) paying one-to-one (1:1) odds in the event a player holds six or more cards totaling no more than twenty, regardless of the contents of the dealer's hand;

m) if the player and the dealer both have blackjack, paying the player one-to-one (1:1) odds.

12. The method as recited in claim 11 further comprising the dealer hitting on soft 17 and standing on hard 17.

13. The method as recited in claim 11 further comprising designating a second specified suit;

giving the player the option to place a "side bet" before the play of a hand begins;

paying the player three hundred-to-one odds on said side-bet in the event she receives blackjack in said second specified suit in the first round of play.

14. The method recited in claim 13 wherein said second specified suit is the same suit as said first specified suit.

15. The method as recited in claim 13 further comprising giving a player the option to designate said second specified suit before the beginning of a round of play.

16. The method as recited in claim 11 further comprising giving a player the option to designate said first specified suit before the beginning of a round of play.

17. The method recited in claim 11 wherein said first specified suit is Diamonds.

* * * * *